US010266293B1

(12) United States Patent
Russell et al.

(10) Patent No.: US 10,266,293 B1
(45) Date of Patent: Apr. 23, 2019

(54) METHOD AND SYSTEM FOR VACUUM STOPPERING OF FLUID CONTAINERS

(71) Applicant: Automated Systems of Tacoma, LLC, Tacoma, WA (US)

(72) Inventors: Joshua Russell, Puyallup, WA (US); Morgan Knickrehm, Tacoma, WA (US); Steven Ng, Kent, WA (US); Donald Teodoro, Gig Harbor, WA (US); Royce Tourtillott, Olympia, WA (US)

(73) Assignee: Automated Systems of Tacoma LLC, Tacoma, WA (US)

( * ) Notice: Subject to any disclaimer, the term of this patent is extended or adjusted under 35 U.S.C. 154(b) by 1038 days.

(21) Appl. No.: 14/121,535

(22) Filed: Sep. 15, 2014

(51) Int. Cl.
*B65B 31/04* (2006.01)
*B65B 31/02* (2006.01)

(52) U.S. Cl.
CPC ..... *B65B 31/027* (2013.01); *B65B 31/041* (2013.01)

(58) Field of Classification Search
CPC ..... B65B 31/027; B65B 31/041
USPC ..... 53/432
See application file for complete search history.

(56) References Cited

U.S. PATENT DOCUMENTS 4,186,542 A * 2/1980 Oyagi ..... B67B 3/24 53/109
4,286,389 A * 9/1981 Ogle ..... F26B 5/06 215/307
4,848,419 A * 7/1989 Damen ..... B65B 31/046 53/109
5,163,919 A * 11/1992 Thijs ..... A61M 5/31513 215/DIG. 4
5,309,959 A * 5/1994 Shaw ..... B65B 3/003 141/103
5,373,684 A * 12/1994 Vacca ..... B65B 3/003 53/425
5,519,984 A * 5/1996 Beussink ..... B65B 3/003 53/324
6,223,408 B1 * 5/2001 Vetter ..... B65B 3/003 29/234
7,328,549 B2 2/2008 Kinney et al.
2011/0302884 A1 * 12/2011 Monti ..... B65B 3/003 53/281
2015/0190578 A1 * 7/2015 Okihara ..... A61M 5/28 53/432
2017/0035654 A1 * 2/2017 Py ..... B65B 3/003

* cited by examiner

*Primary Examiner* — Hemant Desai
*Assistant Examiner* — Chinyere J Rushing-Tucker
(74) *Attorney, Agent, or Firm* — Lowe Graham Jones PLLC; Michael J. Folise; David A. Lowe

(57) ABSTRACT

A method, system, and vacuum head assembly provide hermetic sealing of fluid medicament cartridges through vacuum stoppering with the assistance of accurate and repeatable mechanical positioning and handling of the stopper. Inert gasses may be introduced during the stoppering process so as to provide headspace or in the alternative completely eliminate headspace. The stopper may be provided with longingutidly spaced apart sealing and control rings providing an opportunity to introduce a stabilizing gas between the rings and a side wall of the cartridge to be hermetically sealed.

19 Claims, 6 Drawing Sheets

METHOD AND SYSTEM FOR VACUUM STOPPERING OF FLUID CONTAINERS

TECHNICAL FIELD

The invention relates to vacuum stoppering of fluid containers. Specifically the invention relates to methods, assemblies and systems for precisely positioning a resilient stopper in a container having a fluid medicament therein.

BACKGROUND OF THE INVENTION

Preloaded vials and syringes filled with various fluid medicines (herein after "medicaments") have become part of the ordinary procedure for treatment of various maladies and illnesses in the developed world. Whereas in previous generations, medical personnel introduced intramuscular or intravenous medications by filling a graduated syringe through a needle from a fluid medicament bottle by displacing a piston plunger manually to a desired volume. Any air gap between the plunger and the fluid medication was carefully expelled and the injection delivered to the patient. In the modern world, these methods have now been occasionally replaced largely with automated equipment including infusion apparatus which accepts preloaded cartridges or syringes having the fluid medicaments hermetically sealed therein. The prior use of manual syringes and a trained individual to inject a patient allowed the medical specialist to expel from the syringe any air or gaseous bubbles possibly present in the syringe. It is well known that intravenous introduction of any such gas or bubbles may cause an embolism which is typically deleterious to the patient. Automated systems now produce a medicinal cartridge having a resilient stopper therein which preferably does not have any gaseous component between the stopper and the fluid medicament. Such gaseous material and the gap defined by thereby is known in the art as "headspace." In addition to the possibility of embolism, such gas may not be inert, such as conventional atmospheric gas which may include contaminants including microorganism possibly causing deleterious positive bacterial growth within the medicament. Such headspace may also cause dosing errors in customized infusion equipment. Efforts to automate the process of filling such fluid cartridges and vials and stoppering the same have made significant progess. The most successful such processes is the so called vacuum stoppering of syringes. As used herein, the terms "fluid container," "fluid cartridge," fluid syringe," "syringe vial," and the like are interchangeable. Furthermore, the terms "stopper", "piston" and "plunger" may be used interchangeably as is the custom in the industry. Under this method, a syringe filled with a medicament or plurality thereof are placed into a multi-cartridge vacuum chamber and a resilient, deformable stopper is placed onto an open upper end of the vial under a partial vacuum. Once the stoppers are appropriately positioned at least partially in engagement with an open throat of the syringes/cartridges the partial vacuum is released and the chamber in which the cartridges reside is vented to atmospheric pressure. Thereupon the stoppers are urged by the differential pressure thereon to enter fully into the cartridges, sealing the same. U.S. Pat. No. 7,328,549 Kinney et al. discloses a process for septic vacuum tilling and stoppering of low viscosity liquids in syringes applying such a vacuum method. Kinney et al. go to great lengths to prevent transition of the liquid medicament to the gaseous phase by suppressing the vapor pressure of the liquid by significantly lowering the temperature thereof during the vacuum stoppering process. Kinney et al. show that doing so substantially reduces the headspace between the medicament and the resilient stopper. Nevertheless, the inventors herein have discovered that the process disclosed by Kinney et al. and others does not position the stopper with sufficient axial accuracy to prevent a gap being formed between the fluid medicament and the stopper. As a result, the fluid medicament can overtime enter the vapor phase creating the undesirable so called headspace.

Other prior art processes for inserting a resilient stopper into medicament cartridges rely on mechanic insertion of the stopper into the cartridge resulting in permanent deformation of the outer side walls of the stopper such as to compromise the desired hermetic seal between the stopper and the cartridge container. The cartridges themselves are typically manufactured from a type of plastic such as polyolefin polymer while the stoppers are typically manufactured from a medical grade silicon coated with a polytetrafluoroethylene (PTFE) low friction coating. In one mechanical prior art technique the cartridges are arranged in an array in a tray inside a vacuum chamber. Individual tubes having an outer diameter smaller than the inner diameter throats on the cartridges are positioned above the open cartridge throats and the tubes are preloaded with the silicon stoppers. The outer diameter of the stopper is significantly radially smaller than the inner diameter of the tubes thus the stoppers are substantially radially deformed while in the tubes. While the chamber is partially evacuated, pistons depress the stopper into the tube which has previously been lowered into position within the cartridges. The stopper emerges from the free end of the tube inside the cartridge where upon the deforming force of the tube has been released and the stopper radially expands to fill the throat of the cartridge. Thus, the stopper has been disadvantageously deformed as specifically the PTFE coating has been deformed beyond its elastic threshold such that upon re-expansion inside the cartridge, the stopper typically wrinkles or other permanent deformities remain. These deformities compromise the hermetic seal, and through capillary action can draw the fluid medicament back out of the cartridge beyond the stopper over time. As a result, the fluid dosage of the cartridge is no longer correct, or the Inverse occurs and ambient atmosphere is drawn into the cartridge.

Thus, a need exists for a method and apparatus which can accurately position elastomeric stoppers into fluid cartridges repeatedly and precisely to a final selected depth. A further need exists to prevent radial deformation of the stopper beyond an elastic deformation limit of a coating on the stopper such that the hermetic seal of the stopper with respect to the container or cartridge is not compromised.

BRIEF SUMMARY OF THE INVENTION

It is therefore an object of the invention to provide a method, apparatus, and system for accurately and repeatibly positioning and elastomeric stopper and a fluid medicament containing cartridge to a final selected depth.

It is yet another object of the present invention to provide a system, method, apparatus which achieves the above object and which also does not radially deform the stopper beyond an elastomeric stopper deformation limit which would adversely affect a hermetic seal achieved between the stopper and the cartridge.

The invention achieves the above objects and other objects and advantages which will be apparent from the description which follows by providing a method for vacuum stoppering of medicinal cartridges of the type having a substantially cylindrical throat defining an open top end. In the inventive method, a radially deformable cylindrical stopper is provided for stoppering the throat of a cartridge having a fluid medicament therein. The stopper is grasped with a grasping tool by first applying vacuum to an upper surface of the stopper through the grasping tool. The stopper is advantageously grasped on an end having the stopper threads thus leaving the sidewall and product contacting end undisturbed. The stopper and the grasping tool are positioned in a single unit vacuum chamber placed in contact with an open top end of the cartridge. The chamber is evacuated to a second vacuum pressure and the stopper is inserted into the throat of the cartridge with the grasping tool to a first selected depth without excessively deforming the stopper beyond a critical radial deformation value. Simultaneously, the vacuum in the chamber is reduced and the stopper is advanced with the grasping tool to a final selected depth whereby the stopper is accurately urged into the cartridge throat to the final selected depth both by the reduced vacuum in the chamber and the mechanical force applied by the grasping tool to the stopper. In a preferred embodiment of the invention, the magnitude of the second vacuum pressure in the vacuum chamber is less than the magnitude of the first vacuum pressure applied by the grasping tool applied to the stopper. Preferably, the vacuum in the chamber is reduced to the ambient pressure when the stopper is advanced to the final selected depth. In many cases for stoppers having large diameters, the vacuum pressure alone is insufficient to move the stopper to the desired final depth into the container.

In a preferred embodiment of the invention, the stopper is provided with axially spaced apart circumferential sealing and stabilizing rings such that an annular gap can he defined by the rings, the stopper, and an inner side wall of the cartridge throat when the stopper is advanced to the final selected depth. Preferably, during the stopper inserting step the stopper is advanced to the first step where only the sealing ring is fully engaged with the side wall of the cartridge's throat. A stabilizing gas, such as nitrogen, is introduced into the vacuum chamber at or less than atmospheric pressure while the stopper is in the described position. Then, any remaining vacuum in the chamber is reduced and the grasping tool is advanced to the final selected depth before the chamber is fully reduced to the ambient pressure so that the stabilizing gas is trapped between the sealing and stabilized rings to prevent ingress of ambient air into the fluid medicaments in the cartridge. The cartridge is preferably weighed before and after the medicament is placed in the cartridge so that the precise volume of the fluid in the cartridge can be determined by weight. Alternatively, before the stopper is inserted to the first selected depth inert sterile air gas can be introduced into the single unit vacuum chamber to provide a known headspace for the fluid with the sterilized inert gas. The stopper is preferably provided with a circumferential coating with a low coefficient of friction.

The invention also preferably includes a vacuum head assembly for use in the non deforming method for vacuum stoppering of the fluid cartridge described above. The assembly preferably includes the main body having a plurality of fluid communication points. The main body also defines a cylindrical open ended chamber for receipt of an elongated annular bell housing. The assembly includes an elongated stopper grasping tool having an internal bore defining an interior vacuum path for grasping the stopper. The stopper grasping tool also defines an exterior vacuum path for a evacuating the cartridge prior to insertion of the stopper therein. The bell housing has a first end adapted to sealingly engage an open throat of a medicament containing cartridge and a distal end having an outer surface adapted for reciprocal axial motion with respect to the main housing, and an interior portion adapted for sealingly reciprocal motion with respect to the grasping tool. The bell housing is preferably biased with respect to the main body by a biasing member, such as a spring to urge the bell housing to an extended position for sealing engagement with the cartridge open end.

The method and vacuum head assembly are preferably part of a system for non deforming vacuum stoppering of fluid cartridges. The system includes the vacuum head assembly described above connected to a motivating device, such as a six axis of freedom robotic arm for positioning the assembly with respect to one or more of a plurality of medicament filled cartridges. This system includes a cartridge processing station adapted to receive a plurality of the cartridges such as in a nest or tray. This system has a stopper loading station fur segregating and isolating an individual stopper such that the stopper can be grasped by the grasping tool. This system preferably has a tare weighing system for weighing the cartridges prior to being filled with fluid and a fill weighing station for weighing the cartridges after they have been filled with fluid. The robotic arm is preferably provided with a mechanism for loading the cartridges with the fluid medicament. In a preferred embodiment of the invention this system includes a tray processing station for providing unprocessed trays of medicament containers to the robotic arm and for removing processed trays from the robotic arm. The tray processing station preferably includes a linear tray motivating device and a tray translating device for positioning unprocessed trays in the cartridge processing station and for removing processed trays onward. A vacuum source is provided for fluid communication with ports on the vacuum head assembly to operate the stopper grasping tool and for evacuating the medicament cartridge prior to stoppering. Associated pneumatic control valves and logic control systems are provided to operate the system in cooperation with a conventional digital computer.

DETAILED DESCRIPTION OF THE PREFERRED EMBODIMENTS

Figure 1:
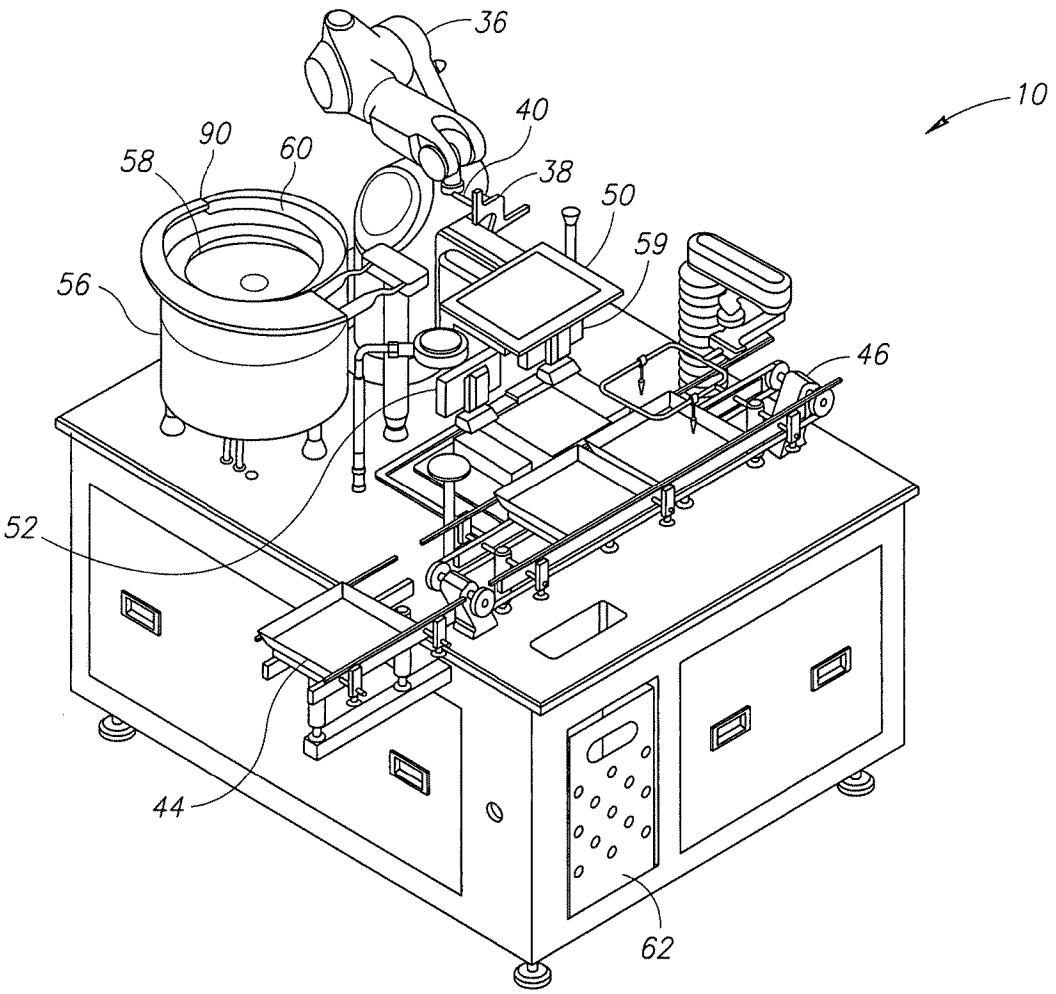
FIG. 1 is a perspective view of a system for a non deforming vacuum stoppering of fluid cartridges.

A non deforming vacuum stoppering system in according with the principles of the invention is generally indicated at reference numeral 10 in FIG. 1 of the attached drawings wherein the numbered elements in the Figures corresponded to like number elements herein. The system 10 includes a variety of components which permit a fluid medicament containing cartridge to be vacuum stoppered to a precise and repeatable depth without radially deforming the stopper beyond an elastomeric deformation limit such that the stopper is incapable of hermetically sealing the cartridge. The system includes one or more vacuum head assemblies, generally indicated at reference number 12 in FIGS. 2-4 adapted for sealingly contacting a fluid medicament cartridge 14 of the conventional type containing a fluid medicament 16 such as chemotherapy or a synthetic medicine or medicament such as insulin. The cartridge 14 has a conventional Leur lock 18 which may later be accessed to release the medicament from the cartridge. The cartridge has an open throat 20 for receipt of an elastomatic stopper 22. The stopper preferably has a lower circumferential sealing ring 24 and an upper circumferential stabilizing ring 26. When fully inserted into the cartridge 14 as showing in FIG. 4B, an inner sidewall 30 of the cartridge can form with the rings an annular gap 28 which will be further described herein below.

As described in further detail below, the stopper 22 is typically manufactured from a resilient polymer such as medical grade silicone and coated with a low friction non reactive coating such as Teflon® or Flurotec®. While the stopper its self is capable of substantial elastic deformation without permanent deformation, the coating is not. Thus is desirable to limit the radial compression of the stopper during the stoppering process to less than a preselected radial deformation limit. Such limits are established by the manufacture but for purposed for this disclosure a limit of 1 mm is acceptable.

Figure 7:
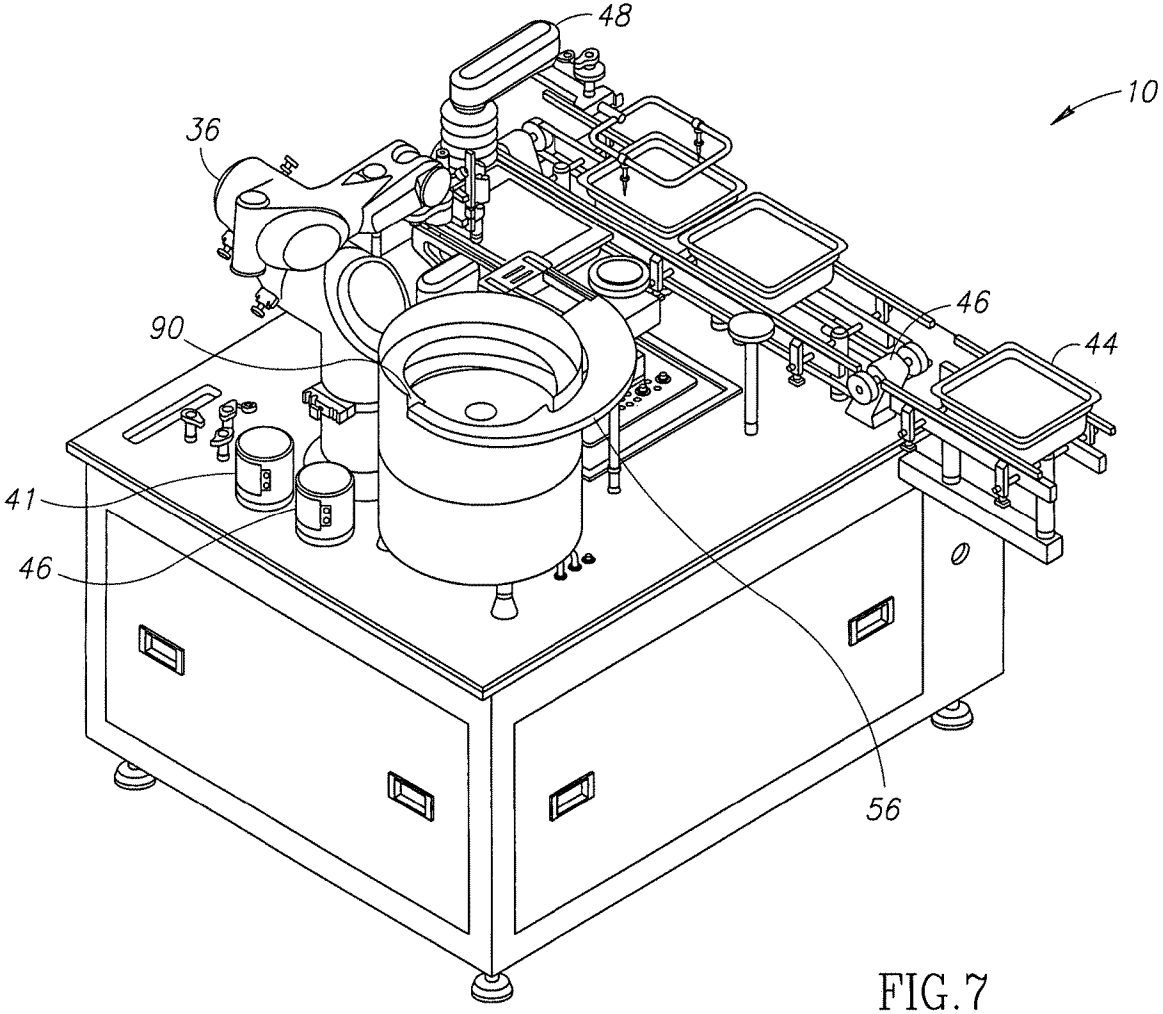
FIG. 7 is a perspective rear view of the system of FIG. 1.

Referring into FIG. 1, the system is provided with a robotic arm 36 having six degrees of freedom supporting on the end thereof a bracket 38 adapted to receive inter alia two of the vacuum head assemblies 12. The bracket also includes a filling needle support for dispensing of the product 40 which can fill the cartridges 14 with a desired medicament. The cartridges are stored in trays 44 on a linear tray motivator 46 which translates the trays to an actuator arm 48which positions the trays on and removes the trays from a cartridge processing station 50. The system includes a tare weighing station 52 and a fill weighing station 54 which are independently positionable beneath the cartridge processing station 50 to weigh the cartridges 20 prior to being filled with medicament by the dispensing system 40 and thereafter to determine the accurate fluid volume within each cartridge. As shown in FIG. 7, the dispensing system 40 employs two precision fluid medicament pumps 41 (piston, peristaltic or time pressure dependent, to dispense the medicament. The system further includes a stopper loading station having a vibrating floor 58 and a circumferential ramp 60 which orientates stoppers individually onto the ramp into a proper presentation for being grasped by the vacuum head assembly 12 prior to a subsequent insertion of the stopper 22 into the cartridges 14. The entire system 10 is preferably enclosed in a conventional aseptic isolation (not shown) to maintain the stability of the environment.

Figure 2:
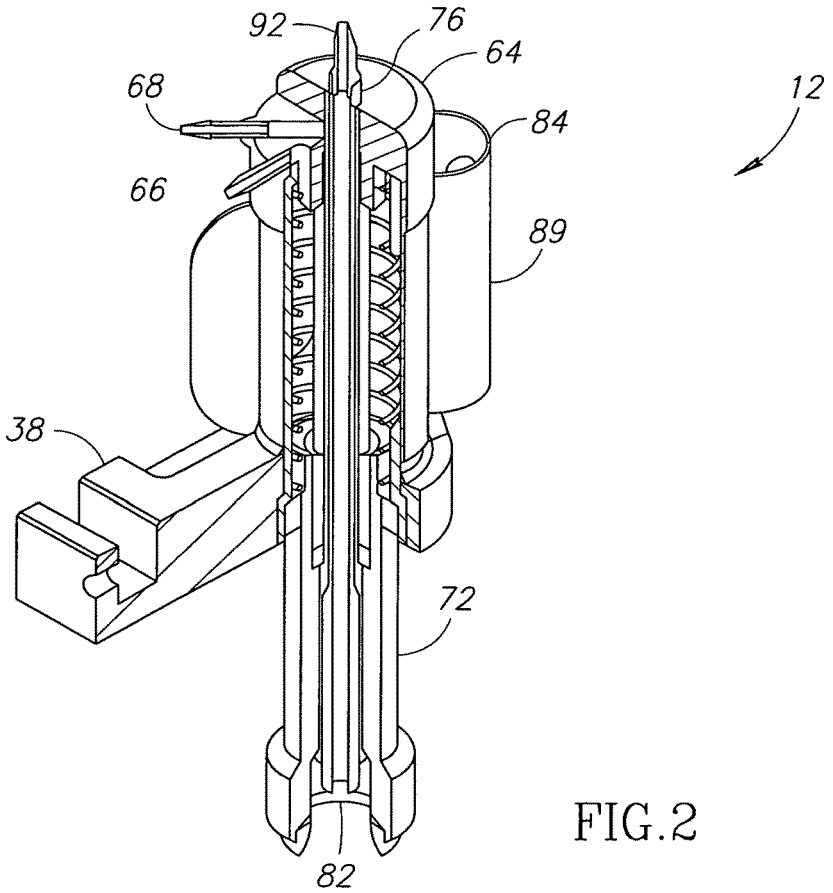
FIG. 2 is a cut away isometric view of a vacuum head assembly for use with the system show in FIG. 1.
Figure 3:
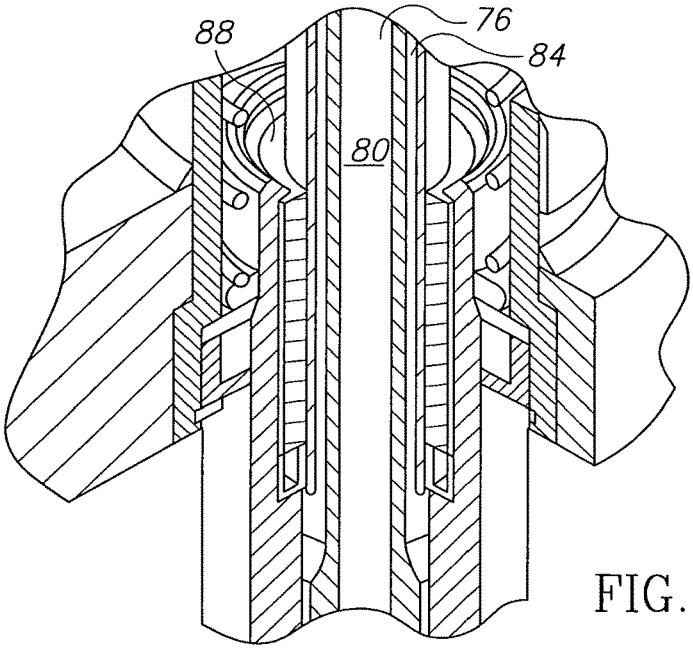
FIG. 3 is an enlarged partial view of the circled area A of FIG. 2.
Figure 4A:
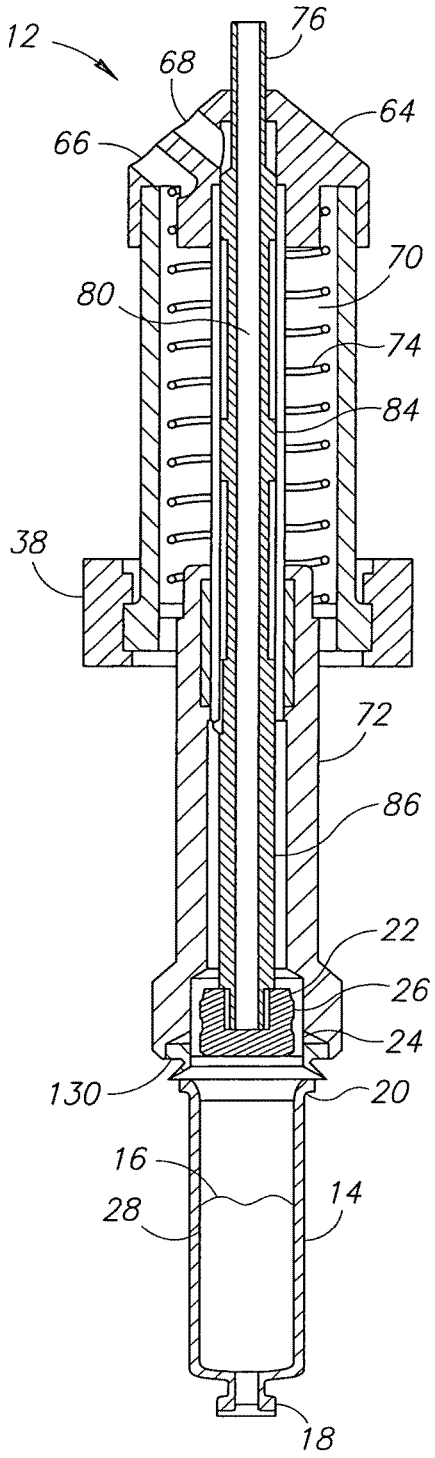
FIG. 4A is a schematic, sectional representation of the vacuum head assembly shown in FIG. 2 in fluid communication with the medicament cartridge prior to insertion of a stopper therein.

With reference to FIGS. 2, 3, 4A, 4B, the vacuum head assembly 12 includes a main body 64 having an atmospheric venting port 66 and a cartridge vacuum port 68 at one end thereof. The main body further defines an open ended chamber 70 adapted for reciprocal receipt of an elongated annular bell housing 72. The bell housing is urged to an extended position by a biasing spring 74 as shown in FIG. 4A. The main body 64 also supports an elongated, hollow stopper grasping tool 76 defining an interior vacuum path 80 terminating in a stopper pick up end 82 for applying a first partial vacuum pressure to an upper surface of the stopper 22 for manipulation thereof. The grasping tool 76 is partially circumferentially surrounded in a spaced apart relationship by a sheath 84 which with the grasping tool 76 defines an exterior vacuum path 86 in communication with cartridge vacuum port 68 for evacuating the cartridge 14 prior to insertion of the stopper 26 therein to a final desired depth as showing in FIG. 4B. The vacuum head assembly 12 includes appropriate seals 88 to prevent the exterior vacuum path 86 from coming into fluid communication with the atmospheric vent port 66.

As shown in FIG. 2, the vacuum head assembly 12 is removably connected to the bracket 38 by a resilient clamp 89. The various components of the assembly are preferably manufactured from materials such as stainless steel and polymers known to those of ordinary skill in the relevant arts which are capable of being autoclaved or treated with various bio-decontamination products. Those products include ethylene oxide, vapor phase hydrogen peroxide and other decomtamination agents known to those of ordinary skill in the bio-decontamination art so as to maintain the sterility of the vacuum head assembly 12.

Operation of this system 10 will now be described. First, empty cartridges 14 are loaded into the processing tray 44 on the linear tray motivator 46. The motivator 46 is operated under control of a conventional digital computer, PLC or robot controller 62 and advances the tray to the actuator arm 48. The actuator arm removes the tray 44 from the motivator 46 and positions the tray 44 in the cartridge processing station 50. The tare weighing station 52 is advanced underneath each individual cartridge 14 prior to filing the same with the medicament and weighs the cartridge of interest. The pipette 40 is then positioned by the robotic arm 36 appropriately with respect to the cartridge of interest and fills the cartridge 14 with a desired volume of medicament 16. Prior to filing, the fill weighing station 54 is positioned under the cartridge of interest and weighs the cartridge either while it is being filled or after filling to determine if additional filing is necessary. Once the desired fill weight has been achieved, the robotic arm 36 motivates the vacuum head assembly 12 and positions the same over the cartridge of interest as shown FIG. 4A.

The stopper loading station 56 also under control of the computer 62 has been continuously feeding and positioning stoppers onto the ramp 60 in preparation for receipt by the stopper grasping tool 76 of the vacuum head assembly 12. The robotic arm 36 positions the assembly at the end location 90 wherein the properly positioned stoppers are known to come to final and singular rest. The arm 36 positions the grasping tool 76 precisely in contact with a flat upper surface of the stopper and initiates a vacuum under computer control though the grasping tool vacuum port 92 at a first partial vacuum pressure such that the stopper adheres to the grasping tool. The robotic arm (under control of the computer system 62) then positions a free end 90 of the vacuum head assembly 12 in sealing contact with the throat 20 of the cartridge 14.

Figure 4B:
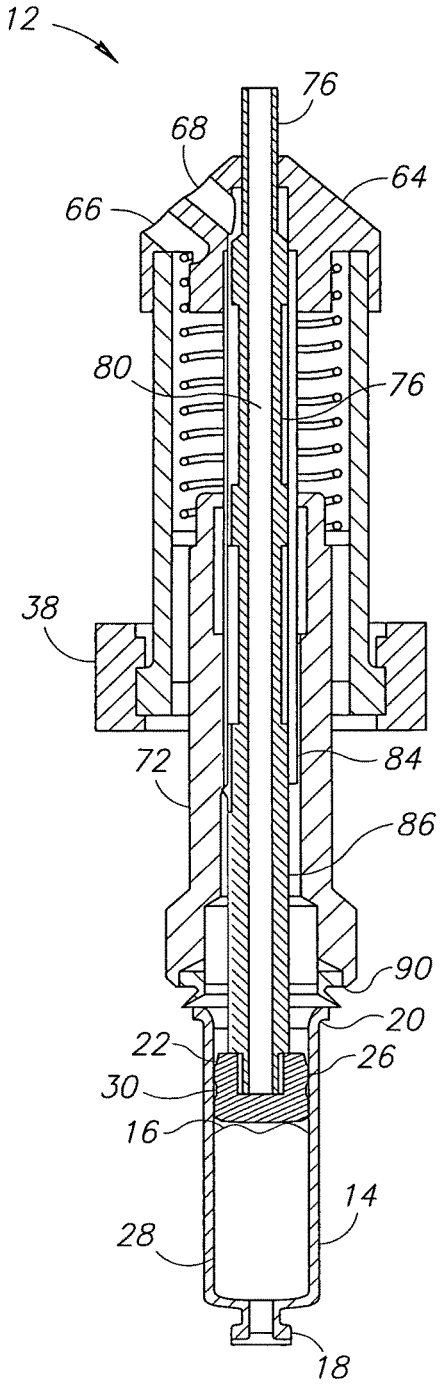
FIG. 4B is a schematic representation, similar to FIG. 4A showing the stopper having been advanced to its final selected depth.

Once the bell housing 72 is in sealing contact with the cartridge 14 a second partial vacuum pressure is applied to the cartridge vacuum port 68 so as to evacuate atmospheric gasses through the exterior vacuum path 86 to the desired partial pressure. The robotic arm 36 then axially advances the bracket 38 and thus the main body 64, stopper grasping tool 76 and thus the stopper 22 downwardly until the sealing ring 24 on the stopper is in contact with the inner sidewall 28 of the throat 20 of the cartridge 14. At this time, an inert gas can be introduced into the exterior vacuum path 86 through the cartridge vacuum port 68 such that when the main body 64 and stopper grasping tool 76 are advanced to the final selected depth as shown in FIG. 4B (wherein the stabilizing ring 26 is also fully engaged with the inner side wall 28) an annular region of stabilizing gas is provided between the rings enhancing the hermetic seal formed between the stopper 22 and the cartridge 14. The robotic arm 36 then axially raises the main body 64 through the bracket 38 and moves on to a next cartridge of interest 14 to be filled and sealed. Once all of the cartridges in tray 44 have been processed, the actuator arm 48 returns the processed tray to the linear tray motivator 46 and an unprocessed tray is brought into position by the motivator.

As is apparent from the above, the precise weight of the medicament in each cartridge 14 is known, and thus the precise volume is known as well. The dimensions of the cartridge also being known, is possible for the computer 62 to direct the robotic arm 36 to precisely axially position stopper 22 to the desired final depth so that there is either no headspace between the fluid 16 and the cartridge and the stopper, or that a known headspace is provided but is filled with an inert gas that will inhibit growth of undesirable biological materials in the cartridge or reduce oxidation of the medicament. In addition, it is possible to provide the annular cavity between the sealing and stabilizing rings on the stopper with an inert gas to prevent ingress of an ambient atmosphere into the now hermetically sealed cartridge.

Figure 5:
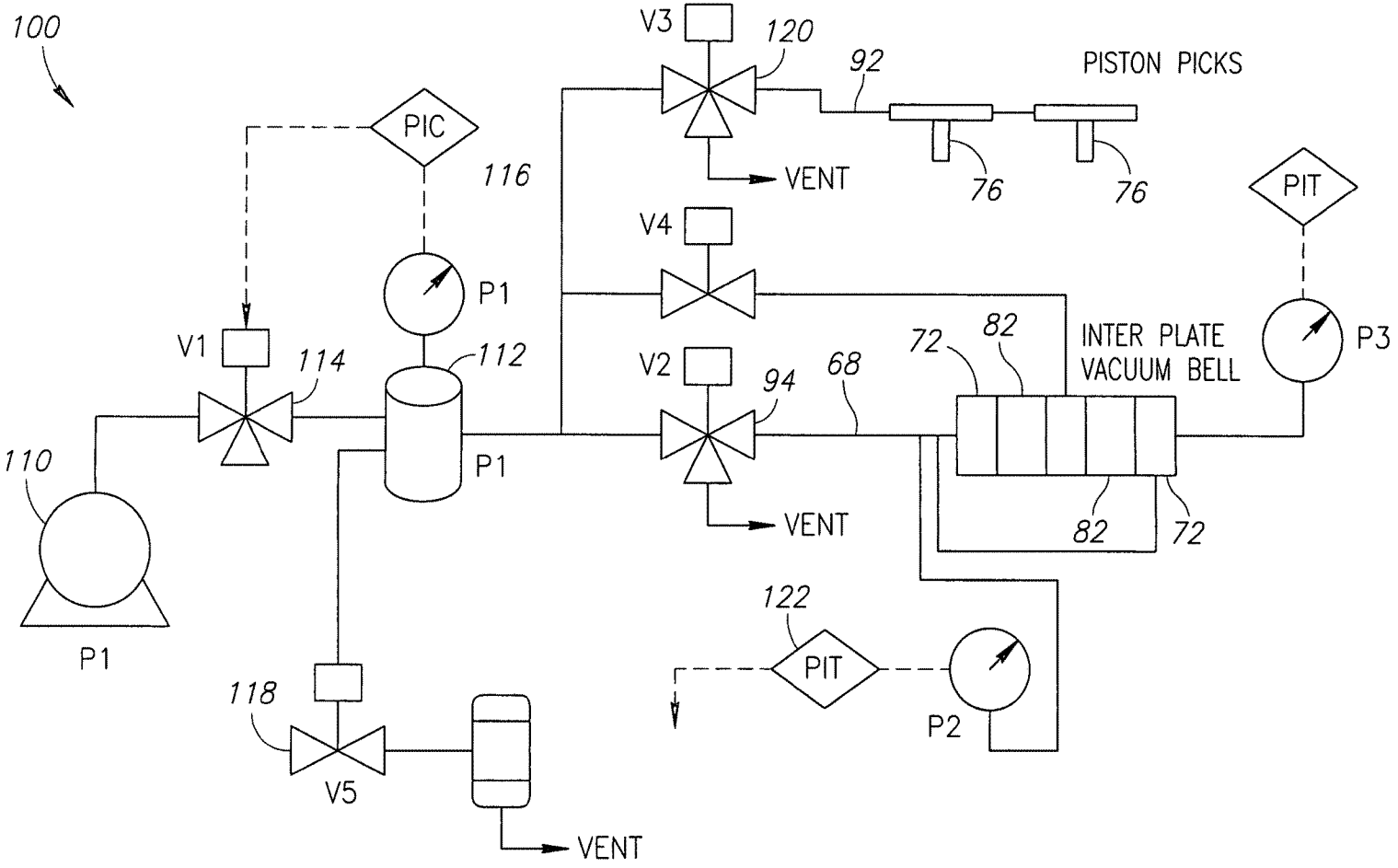
FIG. 5 is a pneumatic diagram of a pneumatic logic control system for operating the vacuum control head assembly.

In order to prevent boil off of the medicament itself during the stoppering process without the necessity of using low temperatures to manipulate the vapor pressure of the fluid, the stoppering process is accomplished relatively quickly. This is possible because the position of the vacuum head assembly is under computer control and is highly accurate such that the vacuum is only applied to the medicament for a short period. In order to carry out this timing sequence, the system 10 is provided with a pneumatic logic system generally indicated in FIG. 5 and reference numeral 100. The pneumatic control system is operatively controlled by the computer 62. As shown in FIG. 5, the pneumatic control system is provided with a vacuum source 110 connected to an accumulator tank 112 by an isolation valve 114. A pressure indicating controller 116 modulates the valve 114 to maintain the correct pressure in the system. The system pressure can also be regulated through a dump valve 118 to atmosphere. A grasping tool valve 120 is in fluid communication with the accumulator tank 112 and the grasping tool vacuum port 92 for application of partial vacuum pressure thereto. A bell housing valve 94 fluidly communicates the accumulator tank 112 with the cartridge vacuum port 68 to control the vacuum in the exterior vacuum path 86 to the cartridge 14. The vacuum pressure in the bell housing 72 is monitored by a pressure transducer 122 in logical communication with the computer 62.

Figure 6:
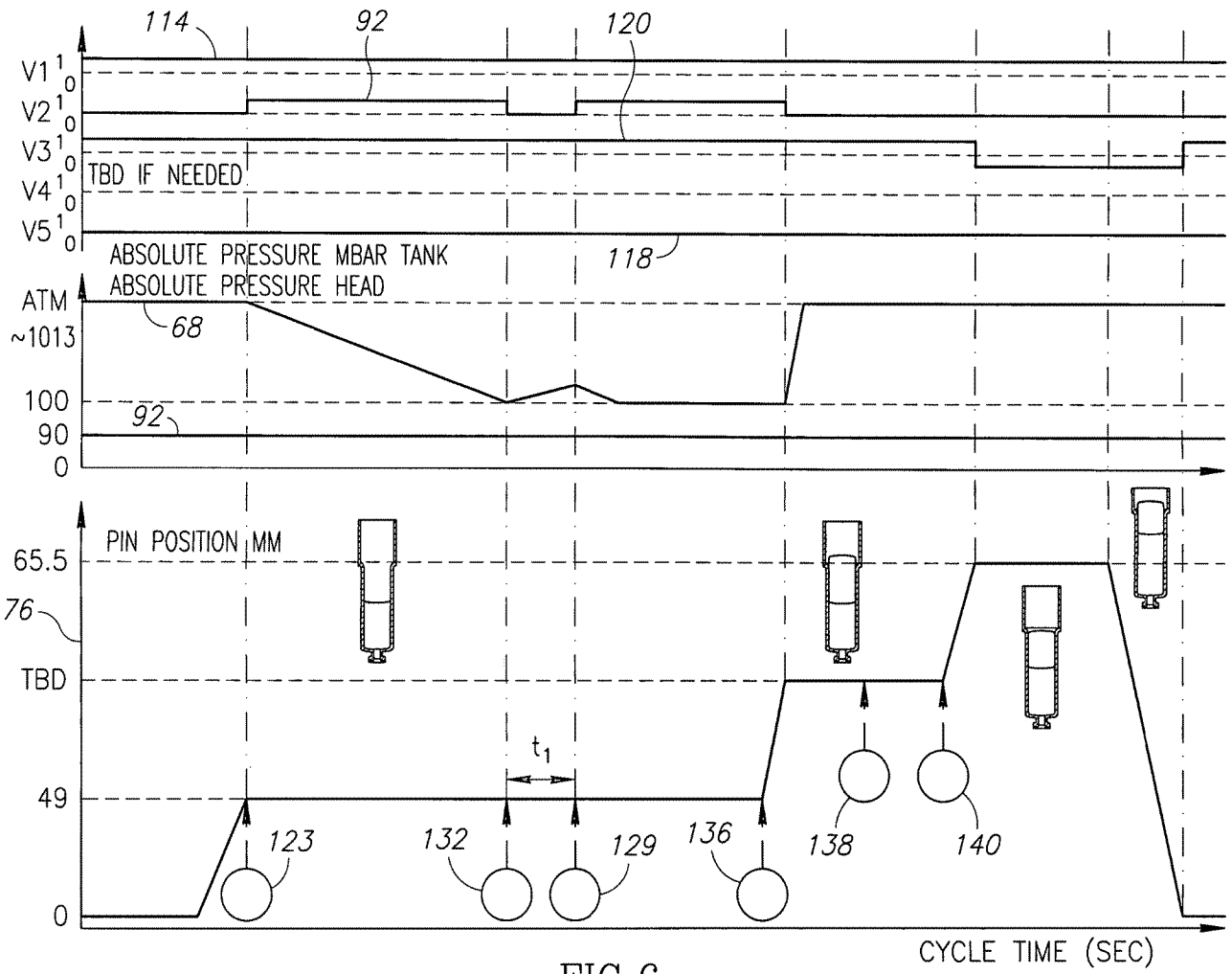
FIG. 6 is a timing chart showing the application of various partial pressures to a stopper grasping tool, and a vacuum chamber of the vacuum head assembly correlated to the position of the stopper within the syringe and positions of the various controls valves all with respect to time.

The computer 62, pneumatic control system 100, vacuum assembly 12 and robotic arm 36 cooperate so as to execute the timing shown in FIG. 6 with respect to the various valves, vacuum pressures and axial position of the stopper grasping tool 76. As showing in the lower graph, the axial grasping tool's position with respect to the throat 20 of the cartridge 14 is showing in the lower graph on the vertical axis and time is shown on the horizontal axis in the conventional fashion.

The middle graph represents the absolute pressure in millibars applied to the grasping tool vacuum port 92 and thus the grasping tool 76 and the cartridge vacuum port 86 and thus the cartridge 14. The upper graph shows the positions (open=1, closed=0) of the various valves shown in FIG. 5 with respect to time.

As shown in the lower graph, the stopper grasping tool 76 is at a rest position (equals zero depth) until a first position 128 is reached at which time the pressure in the bell housing 94 is still at atmospheric pressure of 1013 millibars while the upper grasping tool maintains a pressure of 90 millibars vacuum to hold onto the stopper 22. At the first position, the robot arm 36 axially advances the vacuum head assembly 49 millimeters towards the throat 20 of the cartridge 14 and a free end 130 of the bell housing comes into contact with the cartridge. At that point, a second pressure is applied to the cartridge vacuum poi t 68 reducing the absolute pressure in the exterior vacuum path 86 to approximately 100 millibars at a second point 132. A time period (t1) of approximately 30 milliseconds the second vacuum pressure is applied to the cartridge 14 thereby limiting the opportunity for the fluid therein to enter the gaseous state(i.e. boil) and allowed to stabilize. An additional time period defined by a third point 134 to a fourth point 136 assures the full atmospheric gasses have been removed from the cartridge. Between the forth point 136 and a fifth point 138 the cartridge grasping tool 76 is advanced to a position in which the first sealing ring 24 is in contact with the inner side walls 28 of the cartridge 14. At this point an inert gas may be introduced into the exterior vacuum path 86 such that at a sixth point 140 in the cycle time, the grasping tool is advanced to 65.5 mm and the stabilizing ring 26 is fully engaged with the inner sidewall of the cartridge 28 as shown in FIG. 4B. The stabilizing gas is trapped in an annulus defined by the rings and the side wall. As shown in the middle graph, between the fourth point 136 and fifth 138, the cartridge vacuum port 68 is vented to atmospheric pressure between the fifth point 138 and the sixth point 140, the cycle time, the grasping tool 76 is advanced to the final selected depth. Thus, both mechanical force applies by the robotic arm 36 through the grasping tool 76 and the differential pressure between the chamber 70 and the cartridge 14 urge the stopper 22 into the final selected depth. The second partial vacuum pressure of 100 millibars absolute pressure has been selected to be insufficient on its own to overcome the coefficient of static and dynamic friction between the stopper 22 and the cartridge sidewall 28 such that the stopper will not move without application of mechanical force under the control of the robotic arm and grasping tool 76. In this way, very little mechanic force is needed to precisely position the stopper within the throat of the cartridge 14 to any desired depth avoiding the application of excessive force on the stopper. In comparison to systems relying solely on differential pressures to advance the stopper, excessive shear forces are avoided preventing undesirable deformation of the Teflon®, silicone or Flurotec® coating on the rubber stopper. Finally, at no time during the cycle shown in FIG. 6 does the stopper experience any excessive radial compression which would exceed the elastic deformation limit. This avoids wrinkles and other surface irregularities in the seal between the stopper and the cartridge. The invention thus insures that the hermetic seal between the stopper and cartridge is not compromised.

Those of ordinary skill in the art will conceive of other alternate embodiments of the invention upon reviewing this disclosure. Thus, the invention is not to be limited to the above description, but is to be determined in scope by the claims which follow.

We claim:

1. A method for vacuum stoppering of medicinal cartridges having a substantially cylindrical throat defining an open top end with a vacuum head assembly, comprising the following steps:

providing a radially deformable cylindrical stopper for stoppering the throat of a cartridge having a fluid medicament therein;

grasping the stopper with a grasping tool in the vacuum head assembly by applying a first vacuum pressure to an upper surface of the stopper through the grasping tool;

positioning the stopper and the open top end of the cartridge in a single unit vacuum chamber; evacuating the chamber to a second vacuum pressure;

inserting the stopper into the throat with the grasping tool to a first selected depth without radially deforming the stopper beyond a critical radial deformation value; and reducing the vacuum in the chamber and advancing the stopper with the grasping tool to a final selected depth, so that the stopper is accurately urged into the cartridge throat to the final selected depth both by the reduced vacuum in the chamber and mechanical force applied by the grasping tool.

2. The method of claim 1, wherein the magnitude of the second vacuum pressure in the vacuum chamber is less than the magnitude of the first vacuum pressure applied by the grasping tool to the stopper.

3. The method of claim 1, wherein during the vacuum reducing step the vacuum in the chamber is reduced to ambient pressure.

4. The method of claim 3, including the steps of providing axially spaced apart circumferential sealing and stabilizing rings on the stopper such that an annular gap can be defined by the rings, the stopper and an inner sidewall of the cartridge throat when the stopper is advanced to the final selected depth; wherein during the stopper inserting step the stopper is advanced to the first depth wherein only the sealing ring is fully engaged with a sidewall of the cartridge throat, then a stabilizing gas is introduced into the vacuum chamber at less than ambient pressure; and then a remaining vacuum in the chamber is reduced and the grasping tool advanced to the final selected depth before the chamber is reduced to the ambient pressure.

5. The method of claim 4, wherein the stabilizing gas is an inert gas.

6. The method of claim 4, wherein the remaining vacuum in the chamber is reduced and the grasping tool advanced to the final selected depth simultaneously.

7. The method of claim 1, wherein the cartridge is weighed before and after the medicament is placed in the cartridge.

8. The method of claim 1, wherein prior to the chamber evacuating step an inert gas is introduced in to the chamber and the stopper is inserted to the first selected depth to provide a layer of inert gas between the medicament and the stopper after the stopper has been advanced to the final selected depth to provide head room for the fluid.

9. The method of claim 1, wherein the stopper is provided with a circumferential coating having a low coefficient of friction.

10. A vacuum head assembly for use in a non-deforming method for vacuum stoppering fluid cartridges, comprising;

a main body having a plurality of fluid communication ports and defining a cylindrical open ended chamber;

an elongated stopper grasping tool having an internal bore defining an interior vacuum path and also defining an exterior vacuum path, the tool being fixedly connected within the main body for axial movement therewith and the exterior vacuum path being in fluid communication with a first one of the fluid communication ports;

an elongated annular bell housing having a first end adapted to sealingly engage an open throat of a medicament containing cartridge and a distal end having an outer surface adapted for reciprocal axial motion with respect to the main body housing and sealingly, reciprocal motion with respect to the grasping tool; and means for biasing the bell housing to an extended position with respect to the main body and a sealing engagement with the cartridge open end wherein the grasping tool further has a co-axial, circumferential, spaced apart exterior sheath which with an exterior surface of the tool defines the exterior vacuum path and wherein the second end of the bell housing is in sealing sliding engagement with the sheath.

11. The assembly of claim 10, wherein a second one of the fluid ports is connected to ambient pressure.

12. The assembly of claim 10, including means for applying a differential vacuum pressure to the first and second vacuum paths.

13. The assembly of claim 10, wherein the biasing means is a spring located within the main housing.

14. A system for non-deforming vacuum stoppering of fluid cartridges, comprising:

a movable vacuum head assembly for applying a first vacuum to a resilient cartridge stopper for handling the stopper and for applying a second vacuum to a fluid containing cartridge, the assembly including an open ended vacuum bell housing having a free end adapted to sealingly engage the fluid cartridge, a main body having a plurality of ports and adapted for reciprocating receipt of the bell housing, and a stopper grasping tool connected to the main body and defining interior and exterior vacuum paths, the grasping tool being fixed to the main body and the bell housing being sealingly reciprocatable with respect to the grasping tool;

a cartridge processing station adapted to receive a plurality of the cartridges;

a stopper loading station for positioning the stoppers to be grasped by the grasping tool;

a fill weighing station for weighing the cartridges after being filled with fluid; and means for loading the cartridges with the fluid and for maneuvering the vacuum head assembly with respect to the stopper loading station and the cartridge processing station.

15. The system of claim 14, wherein the cartridge processing station is adapted to receive a cartridge holding tray.

16. The system of claim 14, including a tray processing station for providing unprocessed trays to, and for removing processed trays from the vacuum head assembly and cartridge loading means.

17. The system of claim 16, wherein the tray processing station includes a linear tray motivating device and a tray translating device.

18. The system of claim 14, wherein the vacuum head assembly and cartridge loading means is a six axis of freedom robot.

19. The system of claim 14 including a vacuum source fluidly connected to the fluid ports and the grasping tool and wherein the vacuum head assembly is manufactured from autoclavable materials.

* * * * *